United States Patent [19]

Aksenov et al.

[11] 3,969,278

[45] July 13, 1976

[54] METALLOCERAMIC CURRENT-CONDUCTING MATERIAL AND A METHOD FOR PREPARING SAME

[76] Inventors: Yakov Dmitrievich Aksenov, pereulok Klumova, II, kv. 31; Georgy Alexandrovich Gumansky, ulitsa Danily Serdicha, 72, kv. 6; Valery Mikhailovich Drako, ul. Zm. Byaduli, 6, kv. 54; Nikolai Konstantinovich Fedoseenko, ulitsa Narodnaya, 22, kv. 44, all of Minsk, U.S.S.R.

[22] Filed: Aug. 28, 1974

[21] Appl. No.: 501,266

Related U.S. Application Data

[63] Continuation-in-part of Ser. No. 455,037, March 26, 1974, abandoned, which is a continuation of Ser. No. 275,958, July 28, 1972, abandoned.

[52] U.S. Cl. ..... 252/513; 252/518; 252/519; 75/206; 75/224; 29/182.5

[51] Int. Cl.[2] ..... H01B 1/02

[58] Field of Search ..... 252/513, 518, 519; 75/206, 224, .5 BC, 212; 29/182.5

[56] References Cited

UNITED STATES PATENTS

| | | | |
|---|---|---|---|
| 3,309,643 | 3/1967 | Ferretti et al. | 252/518 X |
| 3,440,042 | 4/1969 | Kaufmann | 75/206 |
| 3,533,760 | 10/1970 | Weizenbach et al. | 75/206 X |

*Primary Examiner*—Benjamin R. Padgett
*Assistant Examiner*—E. Suzanne Parr
*Attorney, Agent, or Firm*—Holman & Stern

[57] ABSTRACT

A sintered metalloceramic current-conducting material contains 60–80 per cent by weight of a of a nickel-chromium alloy as a current-conducting component; 17–35 per cent by weight of fully oxidized aluminium as an insulating component that serves also as a refractory filler material; and 3–5 percent by weight of a mixture of oxides of nickel and chromium which serves to separate particles of the nickel-chromium alloy and to increase the specific electric resistance of the material. The method for preparing the metalloceramic current-conducting material resides in that a powdered nickel-chromium alloy in an amount of 70–90 per cent by weight is mixed with aluminium powder in an amount of 10–30 per cent by weight to prepare a homogeneous mixture, which is then pressed and sintered at a temperature of 800°–900°C in air.

3 Claims, No Drawings

METALLOCERAMIC CURRENT-CONDUCTING MATERIAL AND A METHOD FOR PREPARING SAME

CROSS-REFERENCE TO RELATED APPLICATIONS

The present application is a continuation in part of our application Ser. No. 455,037 filed Mar. 26, 1974, now abandoned, which in turn was a continuation of application Ser. No. 275,958 filed July 28, 1972, now abandoned.

BACKGROUND OF THE INVENTION

The invention relates to the improvement of metalloceramic materials, and more particularly, it relates to sintered metalloceramic current-conducting materials and methods for preparing them.

The invention can advantageously be used in manufacturing powerful resistors used in radio engineering, load resistors for industrial use, and electric elements for household and industrial heating appliances ensuring working temperatures up to 700°C.

Known in the prior art is a metalloceramic current-conducting material and a method for preparing it according to U.S. Pat. No. 3,309,643. The metalloceramic material is prepared on the basis of a powdered nickel-chromium alloy as a current-conducting component, and a refractory filler material such as powdered aluminium oxide. The nickel-chromium powder is taken in an amount of 20 percent by weight, and the amount of aluminium oxide powder is 80 percent by weight, in other words, the metalloceramic material contains a great amount of the refractory filler material, and a small amount of the current-conducting component.

This ratio of the current-conducting component to the refractory filler material is necessary to give a high specific resistance to the current-conducting material which is used for the manufacture of volumetric electric heating elements. However, if the amount of the current-conducting component in the material is small, the distribution of specific electric resistance throughout the bulk of the metalloceramic material is very uneven, which is due to the special sensitivity of such materials to natural heterogeneity of the composition. The necessity of taking the components in the specified ratio to prepare a current-conducting material having a high specific resistance is due to the significant difference in the electric conductivity of the nickel-chromium alloy and the aluminium oxide, and also low resistance of metallic contacts between the nickel-chromium alloy particles. The low resistance of the metallic contacts between the nickel-chromium alloy particles is explained by the fact that the particles of the nickel-chromium alloy are devoid of oxide films that otherwise might insulate them from one another and thus increase the electric resistance of the contacts between them.

The method for preparing the known metalloceramic current-conducting material resides in that one part of the alloy, consisting of about 80 percent of nickel and 20 percent of chromium, is mixed with four parts of aluminium oxide powder for 24 hours, after which the mixture is compacted under a pressure of about 10 tons/sq.cm, and the pressed mixture is sintered at a temperature of 1500°C in hydrogen or another reducing medium for 24 hours.

The known metalloceramic current-conducting material is used as electric elements for household heaters. The preparation of this metalloceramic current-conducting material is however expensive, since the pressing of powders such as aluminium oxide is difficult due to their low plasticity; as a result binders are required and the press-moulds are quickly worn out.

The known method incorporates sintering of the powders of the nickel-chromium alloy and aluminium oxide, which requires heating to temperatures of about 1500°C for a long time to sinter the refractory filler material, the basic component of the known metalloceramic current-conducting material. Moreover, the process for preparing the known metalloceramic current-conducting material is made even more complicated and expensive because it is necessary to use a reducing medium for the sintering process, which is fraught with danger of explosion.

Known also is another metalloceramic current-conducting material and the method for preparing it according to U.S. Pat. No. 3,184,835. The known metalloceramic current-conducting material is prepared on the basis of crushed solid solutions of a readily oxidizable metal such as - beryllium, magnesium, or aluminium, taken in an amount from 0.05 to 0.69 percent by weight, in a matrix of copper or silver.

Oxides of aluminium, magnesium, or beryllium, are refractory insulating components of the metalloceramic current-conducting material, but they are contained in an amount approximately from 0.1 to 1.7 percent by weight. This amount of the insulating refractory material cannot substantially change the specific electric resistance of materials having a low specific resistance such as copper, silver, or their alloys.

The method for preparing the known metalloceramic current-conducting material resides in that solid solutions of a readily oxidizable metal, such as beryllium, magnesium, or aluminium, taken in an amount from 0.05 to 0.69 percent by weight in copper or silver are crushed and oxidized by heating in an oxidizing medium, after which the internally oxidized powder undergoes hot extrusion. During the internal oxidation, minute particles of the oxide of the dissolved metal (beryllium, magnesium, or aluminium) are formed inside the copper or silver matrix.

The formation of the finely dispersed phase of solid oxides of beryllium, magnesium or aluminium improves significantly the mechanical properties of the metalloceramic material without appreciably changing its electrical resistance. This material cannot be used, for example, to manufacture resistors, load resistors, or electric elements for household or industrial heaters due to its low specific electric resistance.

Known in the prior art also is a current-conducting metalloceramic material and the method for preparing it according to Japanese Pat. No. 40-4451. The metalloceramic material is prepared on the basis of ground steel containing from 0.3 to 5 percent by weight of aluminium.

The formation of fine particles of aluminium oxide inside the steel matrix somewhat increases its specific resistance but due to the low content of aluminium oxide in the metalloceramic material, the specific resistance remains low, which makes it impossible to use the material in the manufacture of resistors, load resistors, or electric elements for household and industrial heaters.

The method for preparing this metalloceramic current-conducting material consists in the following. Steel powder containing from 0.3 to 5 percent by weight of aluminium, is dispersed, the powder is oxidized in air at a temperature of 600°C, during which the aluminium, that is present in solid solution in the steel, is oxidized to aluminium oxide, then the steel powder is reduced in a reducing medium, pressed into the required shapes and sintered in a reducing medium. The method increases the refractoriness and strength of the steel without changing substantially its electrical properties. The method is very similar to that covered by U.S. Pat. No. 3,184,835. Both methods fail to prepare metalloceramic current-conducting materials having a high specific resistance and the required refractoriness.

SUMMARY OF THE INVENTION

It is an object of this invention to provide a sintered metalloceramic current-conducting material possessing insignificant variability its resistivity. Another object of the invention is to provide a simple and inexpensive process for preparing a metalloceramic current-conducting material.

These and other objects of the invention have been attained in a method, the essence of which resides in that the proposed sintered metalloceramic current-conducting material contains 60–80 percent by weight of a nickel-chromium alloy as a current-conducting component, 17–35 percent by weight of fully oxidized aluminium as an insulating component serving also as a refractory filler material, and 3–5 percent by weight of a mixture of oxides of nickel and chromium serving to separate particles of the alloy and thus to increase the specific resistance of the material.

This metalloceramic current-conducting material possesses high specific resistance due to the presence of oxide layers that separate the metallic particles of the nickel-chromium alloy and thus increase the electric resistance of the contacts between the metal particles. Moreover, the obtained metalloceramic current-conducting material contains the current-conducting component in an amount greatly exceeding that of the refractory insulating filler material, owing to which the variability of the specific resistance throughout the bulk of the material becomes insignificant.

The great amount of metallic particles of the nickel-chromium alloy coated with an oxide film ensures the presence of a great amount of contacts between the nickel-chromium alloy particles in a unit volume of the material. In this case the natural heterogeneity of the mixture, otherwise irreparable by thoroughly mixing, produces an appreciable effect on the homogenity of the material with respect to its specific electric resistance, or on the uniformity of the values of the specific resistance of the material, since the total number of electric contacts being very great, the presence or absence of certain quantities of such contacts below or above the mean value due to accidental heterogeneity of the mixture composition, is practically insignificant with respect to the total electric resistance.

The proposed metalloceramic current-conducting material can be prepared by a method consisting in that a powder of a nickel-chromium alloy in an amount of 70–90 percent by weight is mixed with aluminium powder in an amount of 10–30 percent by weight to prepare a homogeneous mixture which is pressed and then sintered at a temperature of 800°–900°C in air.

This method for preparing the metalloceramic current-conducting material is simple because the refractory filler material used in the process is aluminium powder which is readily pressed, and thus the process of pressing the mixture of powders of the nickel-chromium alloy and aluminium is simplified and the wear of press-moulds is decreased.

The compacted mixture of powders of the nickel-chromium alloy and the aluminium is sintered in air at a temperature of 800°–900°C for 40–60 minutes, which considerably decreases the cost of preparing the metalloceramic current-conducting material. The material is sintered in air due to the necessity of complete oxidation of the aluminium powder, since aluminium must be present in the metalloceramic current-conducting material in the form of aluminium oxide. Moveover, sintering in air produces oxide films on the surfaces of the nickel-chromium alloy particles, which increase the electric resistance of contacts between the particles of the nickel-chromium alloy.

The latter circumstance ensures high specific electric resistance of the metalloceramic current-conducting material.

Sintering of the compacted mixture of powders of the nickel-chromium alloy and of aluminium powder is simplified and made cheaper by the fact that the process is effected at lower temperatures. During sintering, the aluminium particles are melted, and this accelerates the oxidation of aluminium to aluminium oxide.

The sintered metalloceramic current-conducting material according to the invention is prepared by the following procedure.

Powders of a nickel-chromium alloy, in an amount of 70–90 percent by weight, and aluminium powder in an amount of 10–30 percent by weight, are sieved thoroughly, and 1.5–2 percent by weight of powdered zinc stearate is added to the mixture to improve the pressing conditions.

The powders are loaded into a ball mill and mixed for 90–120 minutes to prepare a homogeneous mixture. The mixed powder is loaded into a press-mould and compacted by a pressure of 7–8.5 tons per sq.cm. to prepare briquettes which are then sintered in air in a muffle furnace at a temperature of 800°–900°C for 40–60 minutes. The furnace is deenergized, and the briquettes are allowed to cool inside the furnace.

The metalloceramic current-conducting material prepared by this method possesses insignificant variability with respect to its specific electric resistance.

DETAILED DESCRIPTION OF PREFERRED EMBODIMENT

For a better understanding of the invention, the following examples of its practical embodiment are given by way of illustration.

EXAMPLE 1

Taken are a fine powder of a nickel-chromium alloy containing 20 percent of chromium and 80 percent of nickel, and a fine powder of aluminium. The ratio of the nickel-chromium alloy powder to the aluminium powder is 90 to 10 (by weight).

1.5–2 percent by weight of zinc stearate is added to the mixture of powders. The zinc stearate burns out in the process of sintering.

The powder of the nickel-chromium alloy and the aluminium powder are loaded into a ball mill (powder to ball ratio 1:2) where the powders are mixed for 90 minutes. After mixing, the powder mixture is pressed into briquettes under a pressure of 8 tons per sq.cm. The briquettes are sintered in a muffle furnace in air at a temperature of 850°C for 50 minutes, and are allowed to cool in the furnace.

Particles of the aluminium powder are oxidized to aluminium oxide during the sintering process.

The obtained metalloceramic current-conducting material contained 78 percent by weight of the nickel-chromium alloy, 17 percent by weight of aluminium oxide, and 5 percent by weight of oxides of nickel and chromium.

In order to stabilize the electric resistance of the obtained metalloceramic current-conducting material after sintering, it is formed by electric current of an industrial frequency of 50 Hz for 2.5 hours, raising the temperature of the material to 1000°–1200°C.

The specific resistance of the metalloceramic current-conducting material obtained in this example is $2\times10^{-4}$ ohm × m. EXAMPLE 2

The procedure for preparing a metalloceramic-current-conducting material is the same as in Example 1, except that the mixture contains 70 percent by weight of the powdered nickel-chromium alloy and 30 percent of the aluminium powder.

The metalloceramic current-conducting material obtained in this example is characterized by a specific resistance of $1.5\times10^{-3}$ ohm × m.

The obtained metalloceramic current-conducting material contained 62 percent by weight of the nickel-chromium alloy, 35% by weight of aluminium oxide, and 3 percent by weight of a mixture of oxides of nickel and chromium.

The metalloceramic current-conducting materials can be used as resistor materials for radio engineering as load resistance in various industries, and as heater elements for household and industrial appliances, operating at temperatures up to 700°C.

We claim:

1. A sintered metalloceramic current-conducting material consisting essentially of 60–80 percent by weight of a nickel-chromium alloy as a current-conducting component, 17–35 percent by weight of fully oxidized aluminum as an insulating component which serves as a refractory filler material, and 3–5 percent by weight of a mixture of oxides of nickel and chromium, the mixture of oxides of nickel and chromium coating the particles of the nickel-chromium alloy which serves to separate the particles of the nickel-chromium alloy and to increase the specific resistance of the material.

2. A method for preparing a metalloceramic current-conducting material comprising: mechanically mixing a powdered nickel-chromium alloy in an amount of 70–90 percent by weight of the total mixture and aluminium powder in an amount of 10–30 percent by weight of the total mixture until a homogeneous mixture is obtained; compresssing moulding the obtained mixture; and sintering the moulded mixture at a temperature of 800°–900°C in air.

3. The method as claimed in claim 2 wherein to the initial mixture is added zinc stearate powder in an amount of 1.5 to 2 percent by weight of the total mixture.

* * * * *